United States Patent [19]

Day

[11] 4,351,793

[45] Sep. 28, 1982

[54] METHOD FOR DRY FORMING A UNIFORM WEB OF FIBERS

[75] Inventor: Winterton U. Day, Neenah, Wis.

[73] Assignee: Kimberly-Clark Corporation, Neenah, Wis.

[21] Appl. No.: 258,266

[22] Filed: Apr. 28, 1981

Related U.S. Application Data

[62] Division of Ser. No. 13,362, Feb. 21, 1979, Pat. No. 4,264,289.

[51] Int. Cl.[3] ..... B29J 5/00

[52] U.S. Cl. ..... 264/518; 264/121

[58] Field of Search ..... 264/518, 121

[56] References Cited

U.S. PATENT DOCUMENTS

| | | | |
|---|---|---|---|
| 2,925,360 | 2/1960 | Roberts | 264/518 |
| 2,931,076 | 4/1960 | Clark | 264/518 |
| 3,055,597 | 9/1962 | Mund | 241/49 |
| 3,581,706 | 6/1971 | Rasmussen | 118/312 |
| 3,792,943 | 2/1974 | Helgesson | 264/109 |
| 4,157,724 | 6/1979 | Persson | 264/122 |

*Primary Examiner*—James R. Hall

*Attorney, Agent, or Firm*—Stephen R. May; Gregory E. Croft; William D. Herrick

[57] ABSTRACT

Method for the deposition of a uniform layer of dry fibers on a foraminous forming surface which comprises passing the fibers through a perforated wall having zones of different aperture sizes in order to provide an even cross-direction basis weight profile.

6 Claims, 2 Drawing Figures

METHOD FOR DRY FORMING A UNIFORM WEB OF FIBERS

This is a division, of application Ser. No. 013,362, filed Feb. 21, 1979 now U.S. Pat. No. 4,264,289 issued Apr. 28, 1981.

BACKGROUND OF THE INVENTION

This invention relates to a method for the deposition of a uniform layer of dry fibers on a forming surface of a foraminous forming wire member.

In prior art distributors such as is described in U.S. Pat. No. 3,581,706, a stream of gas containing fibers is fed into a housing having a perforated plane-surfaced bottom wall; impeller means mounted in the housing for rotation above the upper surface of the perforated wall circulates the stream of fibers in the housing. A foraminous forming surface on a wire member or the like moving beneath the distributor housing and the bottom wall of the housing receives under the influence of vacuum the fibers from the stream to form a fiber layer or web on the traveling foraminous wire member. The vacuum is commonly applied to the foraminous wire member and perforated wall to draw the fibers to the wire member and to separate the gas, usually air, from the fibers. The combination of the perforated bottom wall and the impeller means positioned closely above the surface of the bottom wall serve to, in effect, sift the fibers through the bottom wall to the foraminous member.

A primary object of this invention is to provide a method which improves the uniformity of the deposited fiber web.

A further object of this invention is to provide for a determination of the variations which may occur in the operation of equipment producing fibrous layers in a dry forming procedure, and to further provide a method of minimizing such variations.

SUMMARY OF THE INVENTION

An examination of dry formed webs produced in the apparatus of the prior art has shown that webs tend to have a variable basis weight across the width of the foraminous forming wire. This is apparently occasioned by nonuniform sifting of the fibers resulting from a plurality of factors including the position of impeller means relative to the housing bottom wall and the foraminous member. Streaks of light and heavy basis weight running in the machine direction, that is, the longitudinal direction of the web, have been found by weighing small pieces of a transverse section of the web and correlating the weights with the position on the wire to obtain a basis weight profile. These streaks are not such as to be apparent to the eye. It has been found, however, that for a particular apparatus the basis weight profile is apparently substantially constant, that is, the streaks of light and heavy fiber deposits appear in the same position on the web with continuous operation of the apparatus. The perforated bottom wall, which is commonly used in the apparatus of the prior art, has a square mesh construction. That is, each aperture of the perforated bottom wall is of approximately the same size and the distribution of the apertures uniform as is conventional with wire mesh screens. For example, square mesh constructions ranging from about 8 wires in each direction to about 18 wires in each direction have been employed in the bottom wall.

In accordance with the present invention a perforated bottom wall of selected mesh or aperture sizes is used for air forming equipment operation. For example, a 12-mesh screen zone having relatively small openings may be employed over areas of the foraminous member which tend to receive a relatively heavy fiber deposit while a 10-mesh screen having relatively large openings may be provided over areas of the foraminous member which tend to receive a less dense fiber deposit. The zones of different aperture sizes in accordance with the invention extend longitudinally of the distributor housing and of the foraminous member in side by side relation, segmenting the perforated bottom wall into areas of greater and less fiber throughput. The invention depends on movement of a greater volume of air and fiber through certain screen sections to attain the result.

DETAILED DESCRIPTION OF INVENTION EMBODIMENTS

Figure 1:
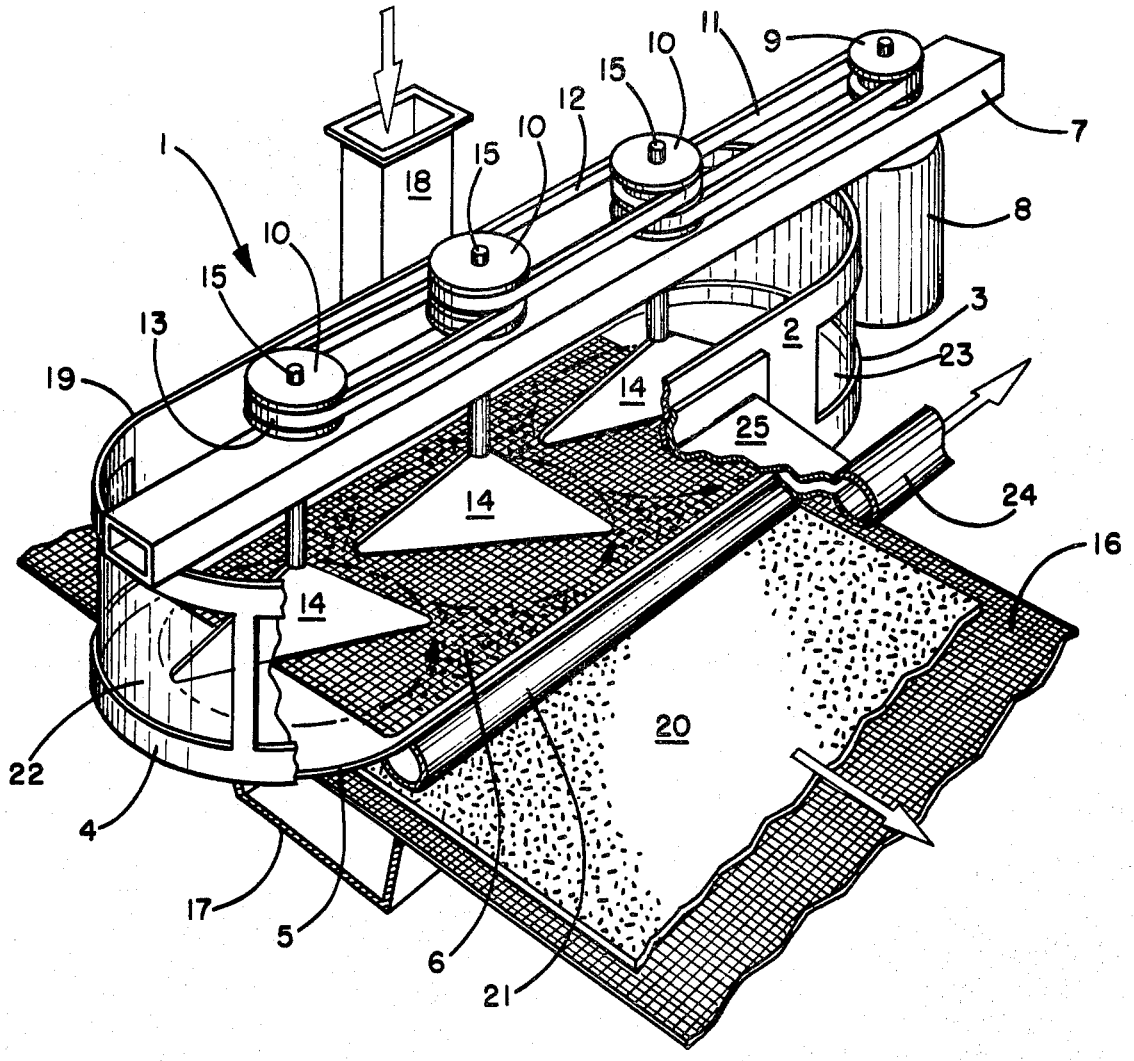
FIG. 1 schematically illustrates, with parts in section and other parts broken away, distributor apparatus for use in the deposition of a layer of dry fibers by an air forming procedure.

In the drawings the numeral 1 generally designates an elongated fiber distributor having an enclosing vertical wall 2 including arcuate end wall portions 3,4. The distributor has a perforated bottom wall 5 and conventionally includes a screen 6 of square mesh construction. The distributor is open upwardly and a beam 7 extends transversely between and on the arcuate end wall portions 3,4.

An electric motor 8 supported in any convenient manner as from beam 7 is provided with a drive pulley 9 which, through driven pulleys 10 and belts 11, 12 and 13, provide power for impellers 14 each mounted on shaft 15. The impellers preferably are all driven in the same rotational direction.

A continuous foraminous member 16 traverses beneath the distributor 1 in known manner in the direction of the arrow. A vacuum box indicated at 17 is positioned below the foraminous member 16 and is adapted to impose a low air pressure on the foraminous member 16 and the perforated bottom wall 5.

The numeral 18 designates an air-fiber inlet communicating (not shown) through the rear 19 of wall 2 and with the interior of the distributor and the impellers. A fiber-air mixture entering through inlet 18 is caused by the impellers to circulate around the interior of the distributor and in conjunction with the imposed vacuum to urge a flow of fibers and air through the perforated bottom wall 5 to the foraminous member 16. The foraminous member has relatively small sized apertures and serves to receive a deposit of fibers while the air of the air-fiber mix is separated from the fibers and passed through the foraminous member 16 under the influence of vacuum to the vacuum box 17. The numeral 20 designates a web of fibers formed on the member 16.

Sealing rollers between wall 2 and the foraminous member 16 extend transversely of the distributor; one such roller is shown at 21 forwardly on the distributor while another (not shown) is similarly positioned rearwardly. The rollers serve to inhibit entry of air to the zone between screen 6 and the foraminous member 16, thereby avoiding disruption of the web 20. Also interiorly of the housing adjacent each arcuate end wall 3 and 4 the perforated bottom wall 5 is provided with air impervious shields 22,23 which prevent the passage of the air-fiber mix through the bottom wall in these end zones, thus limiting the width of the web 20 formed on the foraminous member 16.

The air-fiber mix entering inlet 18 fills the atmosphere within the distributor and circulates from one end of the distributor to the other. The distributor includes means for recycling some of the air-fiber mix from the distributor interior. This includes the conduit 24 which communicates through port 25 to the housing interior. Port 25, only a portion of which is shown in FIG. 1, extends laterally with the distributor over substantially the full distributor width and preferably corresponds in width to the width of the air-fiber inlet entry at the rear of the distributor.

In the operation of the equipment the air-fiber mixture flowing inwardly of the rear of the distributor circulates as already noted and some of the fibers pass through the perforated bottom wall to the foraminous member 16. There is a tendency for fiber lying on the bottom wall outside of the impeller area to clog up the screen and to become essentially dead areas insofar as fiber passage through the perforated wall is concerned. Also, there is a tendency for fiber flowing between the impellers 14 and perforated bottom wall 5 to distribute itself such that the density of the fibers passing through the bottom wall is a variable. This is attributable to a number of factors including centrifugal action of the impellers. The tendency with the particular equipment discussed is to provide on the foraminous wire member several side areas of somewhat greater fiber density than an adjacent intermediate area. Specifically, it was found that the concentration of fibers was such that the basis weight distribution was about

*←High B.W.→/←Low B.W.→/←High B.W.→/*

The perforated bottom wall producing the above indicated nonuniformity was a square mesh screen of 12 mesh. The extent of the nonuniformity was determined by cutting samples from a considerable plurality of positions spaced equally across a web. Each test specimen from the web was 7" long and 3" wide. The 7" dimension was in the machine direction, that is, in the longitudinal running direction of the foraminous member 16. The weight of each specimen was attained and the corresponding basis weight calculated. A variation as much as about ±2 pounds per 2880 sq. ft. in a 17 pound per 2880 sq. ft. basis weight sheet has been found using standard square mesh screening.

It was further found that the cross directional uniformity as to basis weight could be improved by providing a more open screen of 10 mesh in the central low basis weight area. An improvement of as much as 50% in the nonuniformity was obtained. That is, the deviation from the desired 17 pounds per 2880 sq. ft. basis weight was reduced to about ±1 pound per 2880 sq. ft.

Figure 2:
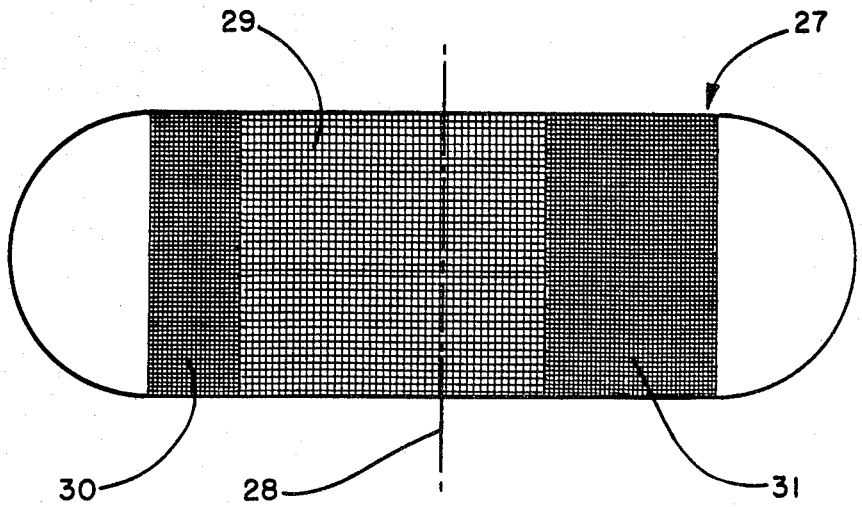
FIG. 2 is a schematic and plan view of one perforated bottom wall found useful in the practice of the invention.

In FIG. 2 there is shown a bottom wall arrangement which accomplishes the above noted improvement. In FIG. 2 a perforated bottom wall 27 which may be substituted for the perforated bottom wall 5 of FIG. 1 is illustrated. The wall 27 has a center-line designated at 28. The wall includes a central 10 mesh screen portion 29 (wire diameter 0.025 inches) having relatively large size apertures. The perforated bottom wall 27 further includes two 12-mesh screen portions 30,31 (wire diameter also 0.025 inches) disposed laterally of, and one on each side of, screen portion 29. The portion 31 is of somewhat greater width than the portion 30 and it will be noted that the portion 29 is itself eccentric to the center line of perforated bottom wall 27. While a single screen having various meshes and wire diameters may be provided in screen manufacture, it has been found useful to simply weld together segments of screens of various mesh and wire size to form the perforated bottom wall 27.

While the invention has been described particularly in connection with flat or plane-surfaced bottom walls, it is considered that similar benefits as to the attainment of uniform fiber deposition may be secured when employing arcuate screens or perforated walls.

As many apparently widely different embodiments of this invention may be made without departing from the spirit and scope thereof, it is to be understood that I do not limit myself to the specific embodiments thereof except as defined in the appended claims.

I claim:

1. A method of reducing variations in the basis weight of a layer of fibers produced on a foraminous surface of a traveling screen in a dry forming process by the deposition of fibers from an air-fiber mixture directed to the foraminous surface through a perforated bottom wall of a housing under the influence of impeller means mounted in the housing closely above and spaced from the upper surface of the perforated wall comprising the steps of obtaining a basis weight profile of a transverse section of a layer of the fibers to determine the variation in fiber density across the layer, and providing in the perforated bottom wall zones of differing aperture sizes which extend longitudinally with the foraminous surface of the traveling screen to minimize differences in the basis weight profile of the layer produced.

2. The method as claimed in claim 1 and in which the zones of different sizes are provided in a plane-surfaced bottom wall.

3. A method of reducing cross-machine direction variations in the basis weight of a layer of fibers comprising:

(a) conveying a stream of gas-suspended fibers to and through housing means having a perforated bottom wall;

(b) collecting said fibers on a movable foraminous forming surface movable longitudinally beneath said perforated bottom wall;

(c) assisting the formation of said fibers into a web on said foraminous forming surface by vacuum means positioned beneath said forming surface;

the improvement comprising:

(d) obtaining a cross-direction basis weight profile of a transverse section of said web and determining the variation in fiber density across said transverse section, and (e) providing said perforated bottom wall with zones of different aperture sizes extending longitudinally in side-by-side relation segmenting said bottom wall into areas of greater and lesser fiber throughput.

4. The method as recited in claim 3, further comprising providing said perforated bottom wall as a plane-surfaced bottom wall having zones of different aperture sizes extending longitudinally in side-by-side relation.

5. The method as recited in claim 4, further comprising providing the zones of different aperture sizes with different widths across said perforated bottom wall.

6. The method as recited in claim 5, further comprising providing a zone of greatest width between zones of lesser width, said zone of greater width being eccentric to a center-line of the bottom wall passing longitudinally through the bottom wall.

* * * * *